US012152463B2

(12) United States Patent
Rushing et al.

(10) Patent No.: US 12,152,463 B2
(45) Date of Patent: Nov. 26, 2024

(54) STAGE TOOL

(71) Applicant: INNOVEX DOWNHOLE SOLUTIONS, INC., Houston, TX (US)

(72) Inventors: Anthony Rushing, Houston, TX (US); Kevin Smith, Houston, TX (US); Greg Roger, Houma, LA (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 18/006,537

(22) PCT Filed: Jul. 29, 2021

(86) PCT No.: PCT/US2021/043689

§ 371 (c)(1),
(2) Date: Jan. 23, 2023

(87) PCT Pub. No.: WO2022/026698

PCT Pub. Date: Feb. 3, 2022

(65) Prior Publication Data

US 2023/0258054 A1 Aug. 17, 2023

Related U.S. Application Data

(60) Provisional application No. 63/058,804, filed on Jul. 30, 2020.

(51) Int. Cl.
*E21B 33/16* (2006.01)
*E21B 34/10* (2006.01)

(52) U.S. Cl.
CPC ..... *E21B 33/16* (2013.01); *E21B 34/10* (2013.01); *E21B 2200/06* (2020.05)

(58) Field of Classification Search
None
See application file for complete search history.

(56) References Cited

U.S. PATENT DOCUMENTS 3,948,322 A * 4/1976 Baker ..... E21B 33/127 166/187
4,421,165 A * 12/1983 Szarka ..... E21B 34/14 166/151

(Continued)

FOREIGN PATENT DOCUMENTS

WO 2016077711 A1 5/2016

OTHER PUBLICATIONS

International Search Report and Written opinion dated Nov. 8, 2021, PCT Application No. PCT/US2021/043689, 16 pages.

*Primary Examiner* — Catherine Loikith
(74) *Attorney, Agent, or Firm* — MH2 Technology Law Group LLP

(57) ABSTRACT

A downhole tool includes a body defining an axial bore and one or more radial ports. The downhole tool also includes a first sleeve positioned at least partially within the body. The first sleeve is configured to block fluid communication from the axial bore through the one or more radial ports when the downhole tool is in a first position. Fluid flow is permitted from the axial bore through the one or more radial ports when the downhole tool is in a second position. The downhole tool also includes a second sleeve positioned at least partially within the body. The second sleeve is configured to block fluid communication from the axial bore through the one or more radial ports when the downhole tool is in a third position. The downhole tool also includes a seat coupled to the second sleeve. The seat is configured to receive an impediment.

21 Claims, 7 Drawing Sheets

(56) References Cited

U.S. PATENT DOCUMENTS

| | | | | |
|---|---|---|---|---|
| 5,024,273 | A | 6/1991 | Coone et al. | |
| 7,237,611 | B2 * | 7/2007 | Vincent | E21B 33/14 166/374 |
| 9,816,351 | B2 * | 11/2017 | Lirette | E21B 34/12 |
| 2002/0166665 | A1 | 11/2002 | Vincent et al. | |
| 2014/0076578 | A1 | 3/2014 | Hofman et al. | |
| 2015/0021026 | A1 | 1/2015 | Giroux | |

* cited by examiner

STAGE TOOL

CROSS-REFERENCE TO RELATED APPLICATIONS

This application is a U.S. National Stage application of PCT/US2021/043689, filed Jul. 29, 2021, which claims priority to U.S. Provisional Patent Application No. 63/058,804, filed Jul. 30, 2020, the entirety of which are incorporated by reference.

BACKGROUND

A casing string is typically cemented within a wellbore by cement slurry that is pumped down the casing string. A wiper plug is used to push the cement slurry through the casing string. Once out of the casing string, the cement slurry flows upward within an annulus formed between the casing string the wellbore wall, where it may be allowed to set. When the entire length of the casing string cannot be cemented within the wellbore in this manner, a procedure generally known as "two-stage cementing" is used.

During two-stage cementing, the cement slurry is mixed and pumped into the annulus between the casing string and the wellbore wall from different locations along the length of the casing string. The first location is at the bottom of the casing string, commonly referred to as the first stage cementing position. The second location is at a stage tool that is positioned between the top and bottom of the casing string. As mentioned above, the wiper plug is used to push the cement slurry through the casing string. The wiper plug lands on a seat in the stage tool. The two-stage cementing method is widely practiced, but it has several drawbacks, including that drilling out the wiper plug and seat can be time consuming.

SUMMARY

A downhole tool is disclosed. The downhole tool includes a body defining an axial bore and one or more radial ports. The downhole tool also includes a first sleeve positioned at least partially within the body. The first sleeve is configured to block fluid communication from the axial bore through the one or more radial ports when the downhole tool is in a first position. Fluid flow is permitted from the axial bore through the one or more radial ports when the downhole tool is in a second position. The downhole tool also includes a second sleeve positioned at least partially within the body. The second sleeve is configured to block fluid communication from the axial bore through the one or more radial ports when the downhole tool is in a third position. The downhole tool also includes a seat coupled to the second sleeve. The seat is configured to receive an impediment.

In another embodiment, the downhole tool includes a top sub, a bottom sub defining one or more bottom sub ports, and a housing defining one or more housing ports. The downhole tool also includes a first sleeve positioned radially between the bottom sub and the housing. The first sleeve blocks fluid flow between the one or more bottom sub ports and the one or more housing ports when the downhole tool is in a first position. The downhole tool also includes a second sleeve positioned radially between the bottom sub and the housing. The first sleeve and the second sleeve permit fluid flow between the one or more bottom sub ports and the one or more housing ports when the downhole tool is in a second position. Fluid communicates through the axial bore, the one or more bottom sub ports, and the one or more housing ports, to an exterior of the housing when the downhole tool is in the second position. The second sleeve blocks fluid flow between the one or more bottom sub ports and the one or more housing ports when the downhole tool is in a third position. The downhole tool also includes a landing seat coupled to the second sleeve when the downhole tool is in the first position, the second position, and the third position. The landing seat is configured to receive an impediment. The landing sleeve is configured to be decoupled from the second sleeve in response to pressure applied to the impediment.

A method for cementing a tubular member within a wellbore is disclosed. The method includes running a downhole tool into the wellbore in a first position. A first sleeve of the downhole tool blocks fluid communication from an axial bore of the downhole tool through one or more radial ports of the downhole tool when the downhole tool is in the first position. The method also includes actuating the downhole tool from the first position into a second position. Fluid communication is permitted from the axial bore through the one or more radial ports when the downhole tool is in the second position. The method also includes pumping cement into the wellbore when the downhole tool is in the second position. The cement flows from the axial bore, through the one or more radial ports, and to an exterior of the downhole tool. The method also includes actuating the downhole tool from the second position into a third position. A second sleeve of the downhole tool blocks fluid communication from the axial bore through the one or more radial ports when the downhole tool is in the third position.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
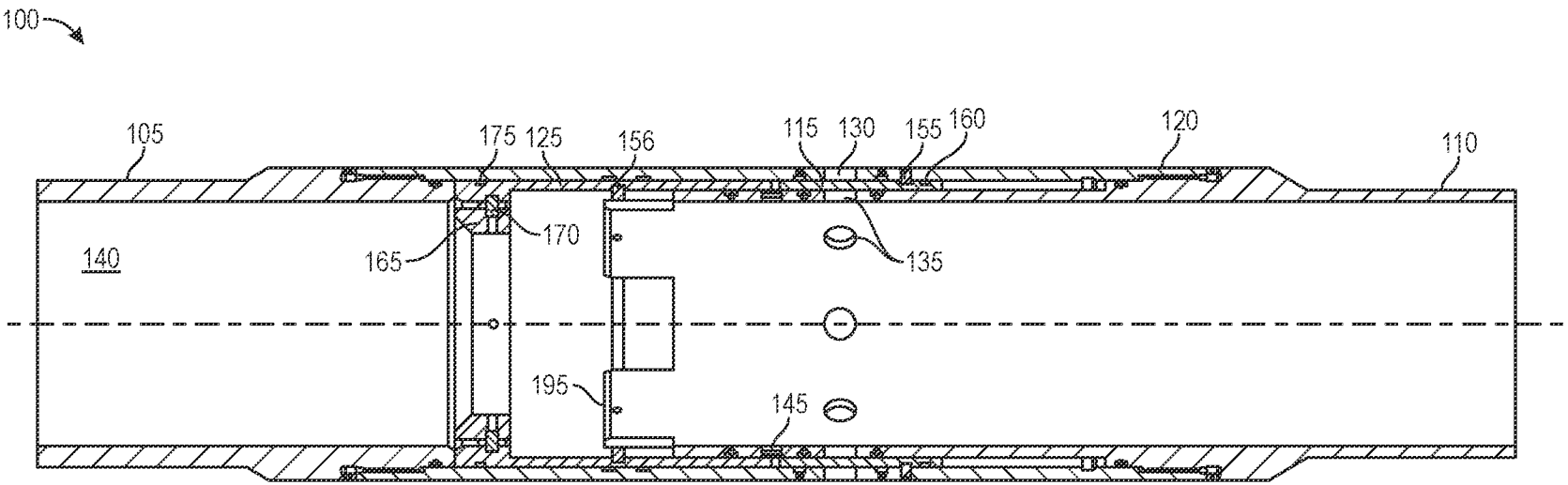
FIG. 1 illustrates a cross-sectional side view of a stage tool in a first (e.g., run-in) position, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a downhole tool 100 in a first (e.g., run-in) position, according to an embodiment. The downhole tool 100 may be or include a stage tool that may be used to perform a cementing operation. The downhole tool 100 includes a first (e.g., top) sub 105 and a second (e.g., bottom) sub 110. The top sub 105 may be positioned above or uphole of the bottom sub 110 (e.g., closer to the top of the wellbore). The bottom sub 110 may include one or more bottom sub ports 135 formed radially therethrough. As mentioned below, fluid may be pumped through the bottom sub ports 135. For example, a cement slurry may be pumped through the bottom sub ports 135 into an annulus between the downhole tool 100 and the wall of the wellbore.

The downhole tool 100 may also include a housing 120 that is positioned at least partially (e.g., axially) between the top sub 105 and the bottom sub 110. The housing 120 may be coupled to the top sub 105 and/or the bottom sub 110. The housing 120 may include one or more housing ports 130 formed radially therethrough. The bottom sub 110 and the housing 120 may be fixed with respect to one another such that the ports 130, 135 may be maintained axially and/or circumferentially aligned with one another. The top sub 105, the bottom sub 110, the housing 120, a combination thereof, and/or other components may be referred to as a "body" of the downhole tool 100. A bore 140 may extend (e.g., axially) through the downhole tool 100 (e.g., through the top sub 105, the bottom sub 110, and the housing 120). The bore 140 may be in fluid communication with the bottom sub ports 135.

The downhole tool 100 may also include a first or "opening" sleeve 115 that is positioned at least partially between the bottom sub 110 and the housing 120. For example, the opening sleeve 115 may be radially between the bottom sub 110 and the housing 120. The opening sleeve 115 may be configured to block fluid communication between and/or through the ports 130, 135 when the downhole tool 100 is in the run-in position, as shown in FIG. 1.

The downhole tool 100 may also include a second or "closing" sleeve 125 that is positioned radially inward from the housing 120. The closing sleeve 125 may be positioned above the opening sleeve 115. The sleeves 115, 125 may be configured to move independently of one another (i.e., one can move with respect to the other and without requiring movement of the other). The closing sleeve 125 may be axially offset from the ports 130, 135 when the downhole tool 100 is in the run-in position. A landing seat 165 may be coupled to or integral with the closing sleeve 125. As mentioned below, once released from the closing sleeve 125, the landing seat 165 is configured to move with respect to the closing sleeve 125. As mentioned below, an anti-rotation feature 195 on the bottom sub 110 may be configured to prevent the closing sleeve 125 from rotating with respect to the bottom sub 110.

In at least some embodiments, the downhole tool 100 may optionally include one or more rupture disks 145. The rupture disks 145 may be positioned in openings formed in the bottom sub 110. The rupture disks 145 may be configured to rupture in response to a predetermined pressure, which allows fluid to flow through the openings in the bottom sub 110 and into an annulus between the bottom sub 110 and the housing 120. As described below, in other embodiments, such rupture disks may be omitted, and shearable members may be provided to prevent actuation of the downhole tool 100 (e.g., the opening sleeve 115) until the fluid reaches the predetermined pressure. In yet other embodiments, the rupture disks 145 may be used in combination with the shearable members.

The downhole tool 100 may also include one or more shearable members (three are shown: 155, 156, 170). The shearable members 155, 156, 170 may be or include shear screws, although any type of shearable member (e.g., shear pins, shear threads, etc.) or combination of different types of shearable members may be used. The shearable member 155 may couple the opening sleeve 115 to the bottom sub 110 and/or the housing 120. As described below, the shearable member 155 may be configured to shear in response to a predetermined force, which allows the opening sleeve 115 to move axially with respect to the bottom sub 110 and/or the housing 120. As mentioned above, the shearable member 155 may be used instead of, or in addition to, the rupture disks 145. The shearable member 156 may couple the closing sleeve 125 to the bottom sub 110 and/or the housing 120. As described below, the shearable member 156 may also be configured to shear in response to a predetermined force, which allows the closing sleeve 125 to move axially with respect to the bottom sub 110 and/or the housing 120. The predetermined force that causes the shearable member 156 to shear may be greater than, less than, or equal to the predetermined force that causes the shearable member 155 to shear. The shearable member 170 may couple the landing seat 165 to the closing sleeve 125. As described below, the shearable member 170 may be configured to shear in response to a predetermined force, which allows the landing seat 165 to move axially with respect to the bottom sub 110, the housing 120, the closing sleeve 125, or a combination thereof. The predetermined force that causes the shearable member 170 to shear may be greater than, less than, or equal to the predetermined force that causes the shearable member 155 to shear. The predetermined force that causes the shearable member 170 to shear may be greater than, less than, or equal to the predetermined force that causes the shearable member 156 to shear.

The downhole tool 100 may also include one or more retaining members (two are shown: 160, 175). The retaining members 160, 175 may be or include C-shaped rings (e.g., snap rings). The retaining member 160 may be configured to be positioned at least partially within a (e.g., radial) recess in the inner surface of the housing 120 and/or the outer surface of the opening sleeve 115. The retaining member 175 may be configured to be positioned at least partially within a (e.g., radial) recess in the inner surface of the housing 120 and/or the outer surface of the closing sleeve 125.

Figure 2:
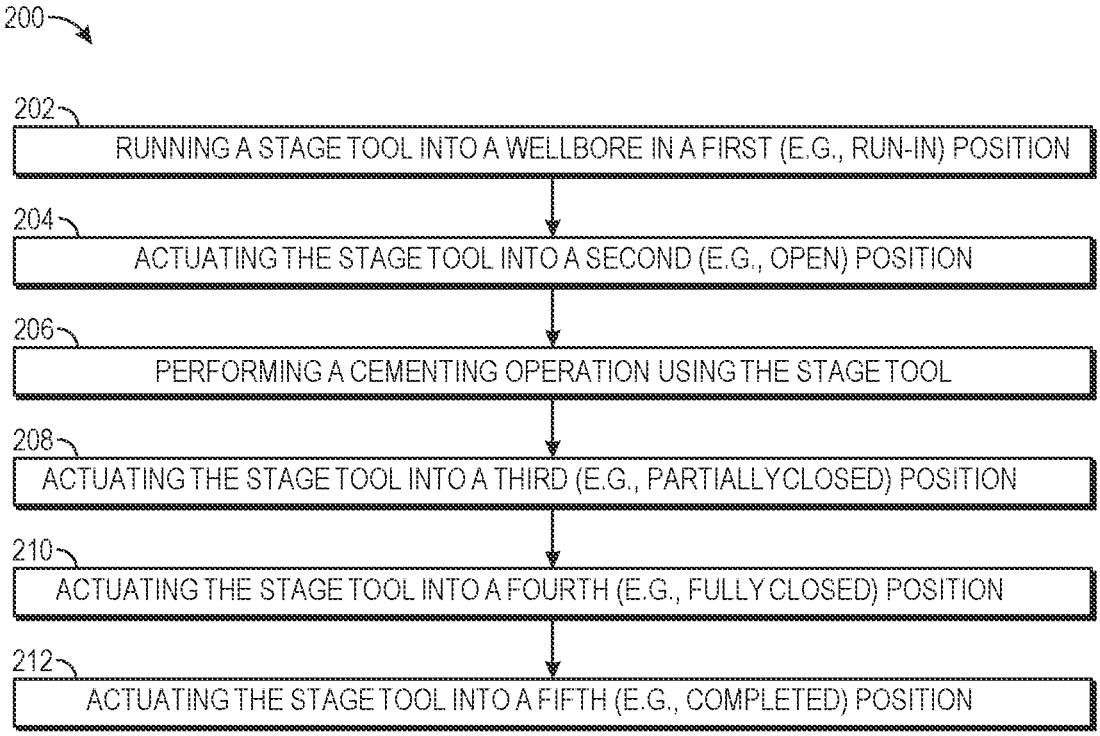
FIG. 2 illustrates a flowchart of a method for cementing a tubular member within a wellbore (e.g., using the stage tool), according to an embodiment.

FIG. 2 illustrates a flowchart of a method 200 for cementing a tubular member (e.g., a casing string) within a wellbore, according to an embodiment. An illustrative order of the method 200 is provided below; however, one or more steps of the method 200 may be performed in a different order, combined, split into sub-steps, repeated, or omitted without departing from the scope of this disclosure.

The method 200 may include running the downhole tool 100 into a wellbore in the first (e.g., run-in) position, as at 202. As mentioned above, the downhole tool 100 is shown in the run-in position in FIG. 1. In the run-in position, the opening sleeve 115 may be positioned between the ports 130, 135 and thereby obstruct fluid communication between and/or through the ports 130, 135. Thus, the opening sleeve 115 may block fluid flow from the bore 140, through the ports 130, 135, and to the exterior of the downhole tool 100.

Figure 3A:
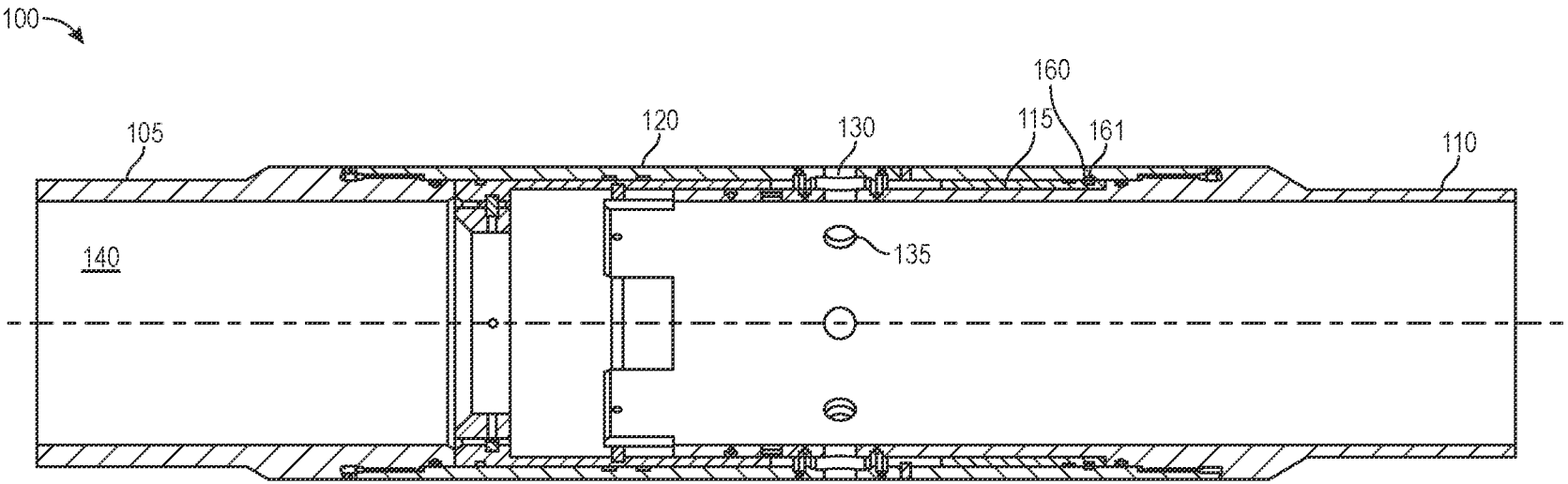
FIG. 3A illustrates a cross-sectional side view of the stage tool in a second (e.g., open) position, according to an embodiment.

The method 200 may also include actuating the downhole tool 100 into a second (e.g., open) position, as at 204. The downhole tool 100 is shown in the open position in FIG. 3A. More particularly, when the downhole tool 100 is in the desired location in the wellbore, the downhole tool 100 may be actuated from the run-in position into the open position. To actuate the downhole tool 100 into the open position, the pressure of a fluid in the bore 140 may be increased to a first predetermined threshold (e.g., using a pump at the surface).

In an embodiment where the rupture disk 145 is present and the shearable member 155 is omitted, the pressure may cause the rupture disk 145 to rupture. The fluid may then flow from the bore 140 into an annulus between the bottom sub 110 and the housing 120. The fluid in the annulus may exert an axial force on the opening sleeve 115 in a downward direction (e.g., to the right in FIG. 3A). In response to the force on the opening sleeve 115, the opening sleeve 115 move axially with respect to the bottom sub 110 and/or the housing 120.

In an embodiment where the rupture disk 145 is omitted and the shearable member 155 is present, the fluid may flow from the bore 140 into the annulus between the bottom sub 110 and the housing 120. The fluid may exert an axial force on the opening sleeve 115 in a downward direction (e.g., to the right in FIG. 3A). The force on the opening sleeve 115 may cause the shearable member 155 holding the opening sleeve 115 to shear. Once sheared, the opening sleeve 115 may move axially with respect to the bottom sub 110 and/or the housing 120.

In an embodiment where the rupture disk 145 and the shearable member 155 are both present, the rupture disk 145 may rupture, allowing the fluid to flow from the bore 140 into the annulus between the bottom sub 110 and the housing 120. The pressure of the fluid in the annulus may then exert a force on the shearable member 155, causing the shearable member 155 to shear, which allows the opening sleeve 115 to move axially with respect to the bottom sub 110 and/or the housing 120. The pressure that causes the rupture disk 145 to rupture may be less than, greater than, or equal to the pressure that causes the shearable member 155 to shear.

Regardless of the embodiment above, the opening sleeve 115 may then move downward (e.g., to the right in FIG. 3A) toward the bottom sub 110 until the retaining member 160 engages an undercut (e.g., a shoulder or recess) 161 in the housing 120. In another embodiment, the retaining member 160 may be omitted, and the opening sleeve 115 may move downward until the opening sleeve 115 contacts the bottom sub 110. Thus, the opening sleeve 115 moves from a first position that prevents fluid communication between the ports 130, 135 (FIG. 1) to a second position that permits fluid communication between the ports 130, 135 (FIG. 2). As a result, the fluid is permitted to flow from the bore 140, through the ports 130, 135, and to the exterior of the downhole tool 100.

Figure 3B:
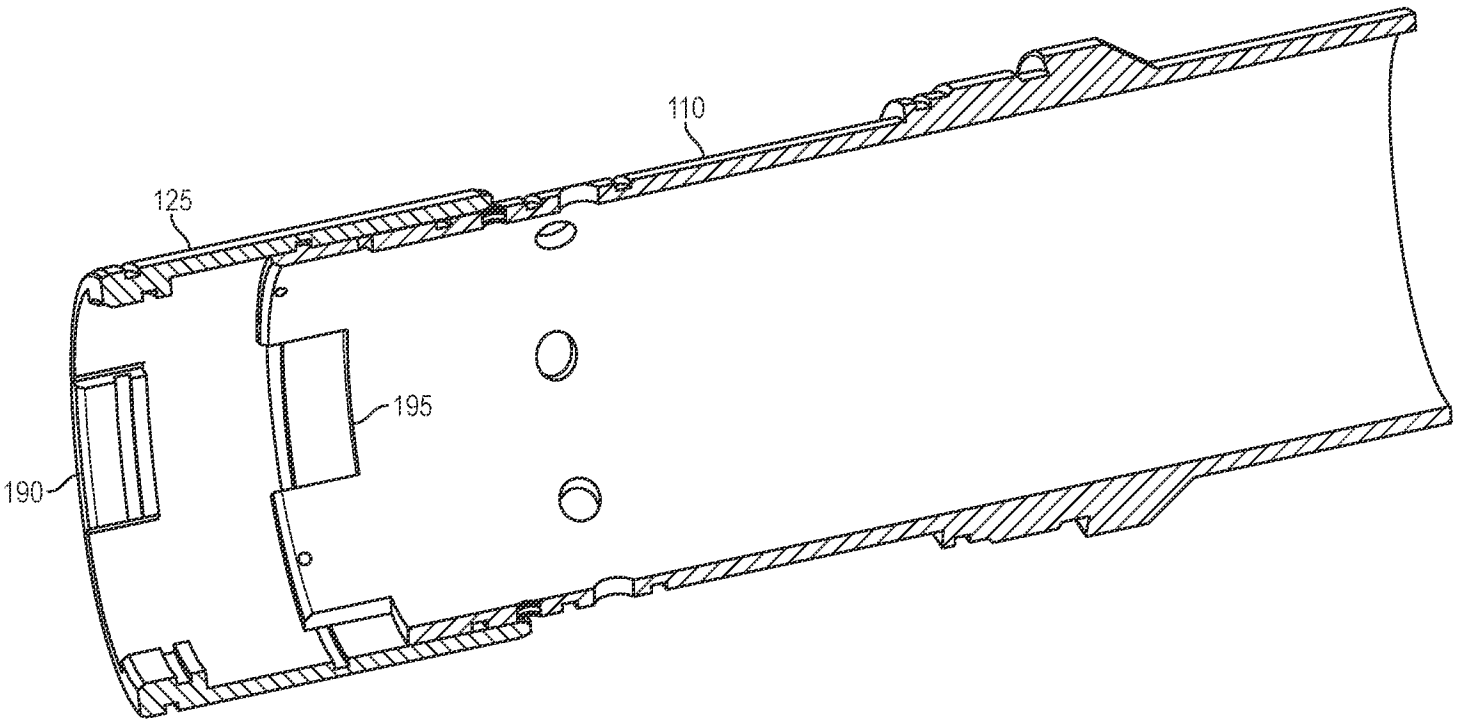
FIG. 3B illustrates a perspective cross-sectional view of a portion of the stage tool in the open position, according to an embodiment.

FIG. 3B illustrates a perspective cross-sectional view of a portion of the downhole tool 100 in the run-in position and/or the open position, according to an embodiment. The inner surface of the closing sleeve 125 may have one or more anti-rotation features 190 coupled thereto or integral therewith. In the embodiment shown, the anti-rotation features 190 may be or include lugs. In another embodiment, the anti-rotation features 190 may be or include slots. As mentioned above, the axial end of the bottom sub 110 may have one or more anti-rotation features 195 coupled thereto or integral therewith. In the embodiment shown, the anti-rotation features 195 may be or include slots. In another embodiment, the anti-rotation features may be or include extensions, such as set screws. The anti-rotation features 190, 195 may be configured (e.g., sized and shaped) to engage one another. The anti-rotation features 190 may be spaced axially apart from the bottom sub 110 (e.g., not positioned within the anti-rotation features 195) when the downhole tool 100 is in the run-in position and/or the open position.

The method 200 may also include performing a cementing operation using the downhole tool 100, as at 206. More particularly, once fluid communication is permitted between the bore 140 and the exterior of the downhole tool 100, cement may be pumped (e.g., from the surface down) into the bore 140. The cement may flow from the bore 140, through the ports 130, 135, and into the annulus formed between the outer surface of the downhole tool 100 and the wall of the wellbore. One or more portions of the tubular member (e.g., casing string) may be positioned above and/or below the downhole tool 100 in the wellbore. The cement may thus also flow into the annulus formed between the outer surface of the tubular member and the wall of the wellbore. The cement may solidify, securing the tubular member in place within the wellbore.

Figure 4A:
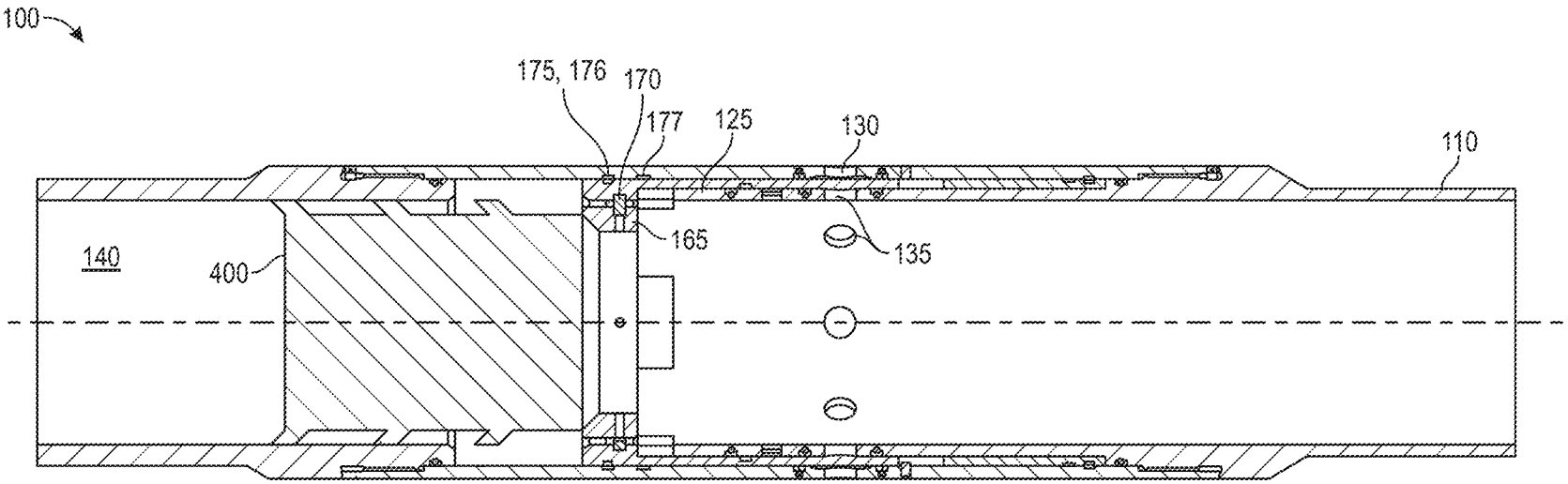
FIG. 4A illustrates a cross-sectional side view of the stage tool in a third (e.g., partially closed) position, according to an embodiment.

The method 200 may also include actuating the downhole tool 100 into a third (e.g., partially closed) position, as at 208. The downhole tool 100 is shown in the partially closed position in FIG. 4A. More particularly, after the cementing operation is complete, an impediment (e.g., plug) 400 may be run (e.g., pumped) into the bore 140 of the downhole tool 100. The impediment 400 may land on the landing seat 165. As mentioned above, the closing sleeve 125 may be coupled to the housing 120 via the shearable member 156 (see FIG. 1), and the landing seat 165 may be coupled to the closing sleeve 125 via the shear member 170.

Once the impediment 400 lands on the landing seat 165, the pressure of the fluid in the bore 140 may be increased to a second predetermined threshold (e.g., using the pump at the surface). The second predetermined threshold may be greater than, less, than, or equal to the first predetermined threshold. The pressure may exert a force on the closing sleeve 125, the landing seat 165, the plug 400, or a combination thereof in the downward direction (e.g., to the right in FIG. 4A). The force may cause the shearable member 156 to shear, which allows the closing sleeve 125, the landing seat 165, the plug 400, or a combination thereof to move in the downward direction toward the bottom sub 110 (e.g., to the right in FIG. 4A). The closing sleeve 125, the landing seat 165, the plug 400, or a combination thereof may move until the retaining member 175 engages an undercut (e.g., a shoulder or recess) 176 in the housing 120. At this point, the downhole tool 100 is in the partially closed position, and the closing sleeve 125 is blocking fluid flow between/through the ports 130, 135. As a result, fluid may not flow from the bore 140, through the ports 130, 135, and to the exterior of the downhole tool 100.

Figure 4B:
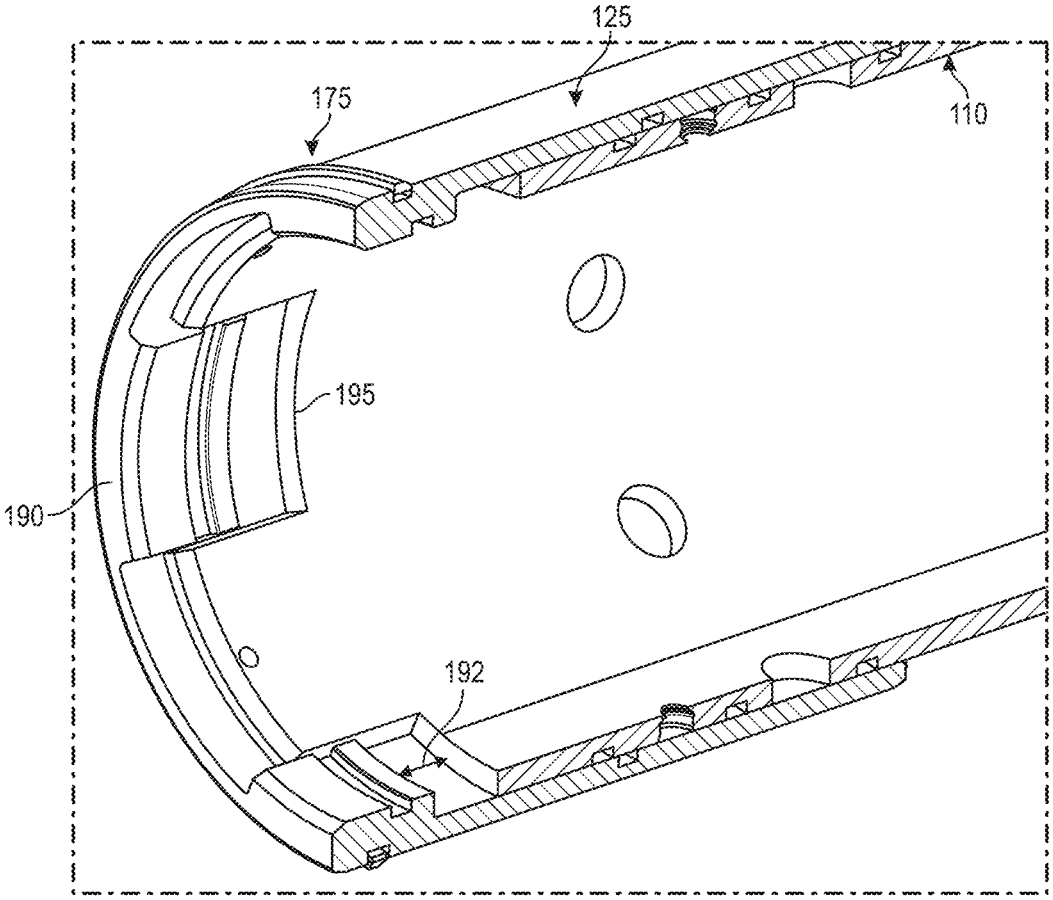
FIG. 4B illustrates a perspective cross-sectional view of a portion of the stage tool in the partially closed position, according to an embodiment.

FIG. 4B illustrates a perspective cross-sectional view of a portion of the downhole tool 100 in the partially closed position, according to an embodiment. The anti-rotation feature 190 may be at least partially engaging (e.g., at least partially within) the anti-rotation feature 195 when the downhole tool 100 is in the partially closed position. For example, an axial gap 192 may be present between the anti-rotation features when the downhole tool 100 is in the partially closed position. This may help to prevent relative rotation between the bottom sub 110 and the closing sleeve 125. As noted above, rotation may also be prevented or resisted using a radial extension and a slot arrangement. However, it will be appreciated that these are just two examples of how rotation may be prevented, and others may be employed consistent with the present disclosure.

Figure 5A:
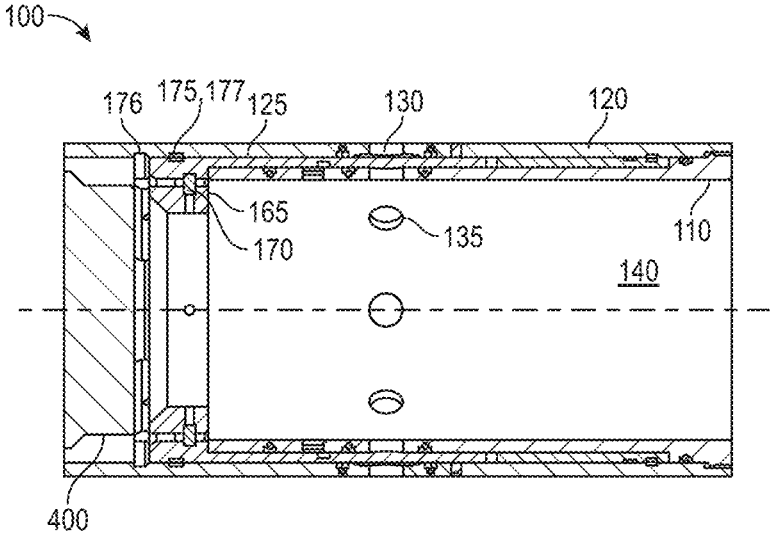
FIG. 5A illustrates a cross-sectional side view of the stage tool in a fourth (e.g., fully closed) position, according to an embodiment.

The method 200 may also include actuating the downhole tool 100 into a fourth (e.g., fully closed) position, as at 210. The downhole tool 100 is shown in the fully closed position in FIG. 5A. More particularly, once the downhole tool 100 is in the partially closed position, the pressure of the fluid in the bore 140 may be increased to a third predetermined threshold (e.g., using the pump at the surface). The third predetermined threshold may be greater than, less, than, or equal to the first predetermined threshold and/or the second predetermined threshold. The pressure may exert a force on the closing sleeve 125, the landing seat 165, the plug 400, or a combination thereof in the downward direction (e.g., to the right in FIG. 5A). The force may cause the retaining member 175 to disengage from the undercut 176, and the closing sleeve 125, the landing seat 165, the plug 400, or a combination thereof may continue moving in the downward direction until the retaining member 175 engages an undercut (e.g., a shoulder or recess) 177 in the housing 120. At this point, the downhole tool 100 is in the fully closed position, and the closing sleeve 125 continues to block fluid flow between and/or through the ports 130, 135.

Figure 5B:
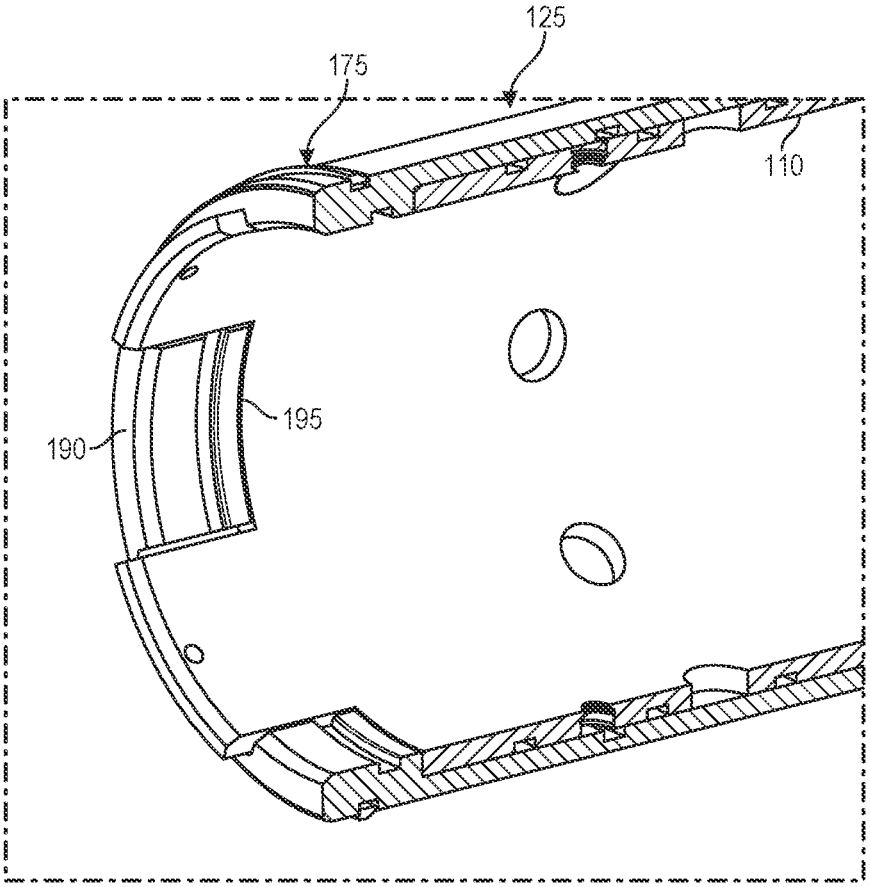
FIG. 5B illustrates a perspective cross-sectional view of a portion of the stage tool in the fully closed position, according to an embodiment.

FIG. 5B illustrates a perspective cross-sectional view of a portion of the downhole tool 100 in the fully closed position, according to an embodiment. The anti-rotation feature 190 may be positioned at least partially (e.g., fully) within the anti-rotation feature 195 when the downhole tool 100 is in the fully closed position. For example, the axial gap 192 (shown in FIG. 4B) may no longer be present, and an axial surface of the anti-rotation feature 190 may be contacting the corresponding axial surface of the anti-rotation feature 195. This may help to prevent relative rotation between the bottom sub 110 and the closing sleeve 125. In addition, the contact may help to prevent the closing sleeve 125 from moving farther in the downward direction.

Figure 6:
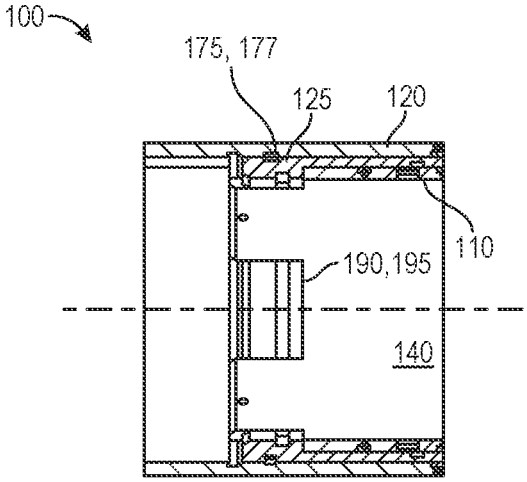
FIG. 6 illustrates a cross-sectional side view of the stage tool in a fifth (e.g., completed) position, according to an embodiment.

The method 200 may also include actuating the downhole tool 100 into a fifth (e.g., completed) position, as at 212. The downhole tool 100 is shown in the completed position in FIG. 6. More particularly, once the downhole tool 100 is in the fully closed position, the pressure of the fluid in the bore 140 may be increased to a fourth predetermined threshold (e.g., using the pump at the surface). The fourth predetermined threshold may be greater than, less, than, or equal to the first predetermined threshold, the second predetermined threshold, the third predetermined threshold, or a combination thereof. The pressure may exert a force on the closing sleeve 125, the landing seat 165, the plug 400, or a combination thereof in the downward direction (e.g., to the right in FIG. 6). The force may cause the shearable member 170 (see FIG. 5A) to shear, which separates the landing seat 165 from the closing sleeve 125. This allows the landing seat 165 and/or the plug 400 to move in the downhole direction and out of the downhole tool 100 (e.g., toward the bottom of the wellbore). At this point, the bore 140 of the downhole tool 100 is now open/unobstructed again. The removal of the landing seat 165 and the plug 400 from the downhole tool 100 eliminates the need of a mill out operation to remove the plug 400, thus making the cementing procedure more efficient.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a body defining an axial bore and one or more radial ports, wherein the body comprises a first anti-rotation feature;

a first sleeve positioned at least partially within the body, wherein the first sleeve is configured to block fluid communication from the axial bore through the one or more radial ports when the downhole tool is in a first position, and wherein fluid flow is permitted from the axial bore through the one or more radial ports when the downhole tool is in a second position;

a second sleeve positioned at least partially within the body, wherein the second sleeve is configured to block fluid communication from the axial bore through the one or more radial ports when the downhole tool is in a third position, and wherein the second sleeve comprises a second anti-rotation feature that is configured to partially engage with the first anti-rotation feature when the downhole tool is in the third position; and a seat coupled to the second sleeve, wherein the seat is configured to receive an impediment.

2. The downhole tool of claim 1, wherein the body comprises a sub and a housing, wherein the first sleeve and the second sleeve are positioned at least partially in an annulus formed between the sub and the housing.

3. The downhole tool of claim 2, wherein the one or more radial ports comprise:

a sub port defined in the sub; and a housing port defined in the housing, wherein the sub port and the housing port are axially and circumferentially aligned with one another.

4. The downhole tool of claim 1, further comprising a shearable member configured to secure the first sleeve in place with respect to the body when the downhole tool is in the first position, wherein the first sleeve blocks fluid communication from the axial bore through the one or more radial ports when the shearable member secures the first sleeve in place, wherein the shearable member is configured to shear in response to the first sleeve being exposed to a predetermined pressure, and wherein the first sleeve shifts to permit fluid communication from the axial bore through the one or more radial ports at least partially in response to the shearable member shearing.

5. The downhole tool of claim 4, wherein the first sleeve comprises a retaining member, and wherein the first sleeve shifts until the retaining member becomes positioned at least partially within a recess in the body.

6. The downhole tool of claim 1, further comprising a shearable member configured to secure the second sleeve in place with respect to the body when the downhole tool is in the first and second positions, wherein the shearable member is configured to shear in response to the second sleeve being exposed to a predetermined pressure, and wherein the second sleeve shifts to block fluid communication from the axial bore through the one or more radial ports at least partially in response to the shearable member shearing.

7. The downhole tool of claim 6, wherein the second sleeve comprises a retaining member, wherein the second sleeve is configured to shift until the retaining member becomes positioned at least partially within a first recess in the body in response to a first predetermined pressure in the axial bore, and wherein the second sleeve is configured to shift again until the retaining member becomes positioned at least partially within a second recess in the body in response to a second predetermined pressure in the axial bore, wherein the second predetermined pressure is greater than the first predetermined pressure, and wherein the first and second recesses are axially offset from one another.

8. The downhole tool of claim 7, wherein the second sleeve blocks fluid communication from the axial bore through the one or more radial ports when the retaining member is positioned at least partially within the first recess and when the retaining member is positioned at least partially within the second recess.

9. The downhole tool of claim 1, further comprising a shearable member configured to couple the seat to the second sleeve, wherein the shearable member is configured to shear in response to the second sleeve, the seat, the impediment, or a combination thereof being exposed to a predetermined pressure, and wherein the seat and the impediment are configured to move out of the downhole tool at least partially in response to the shearable member shearing.

10. The downhole tool of claim 1, wherein an axial gap is present between a portion of the first anti-rotation feature and a portion of the second anti-rotation feature when the first and second anti-rotation features are partially engaged.

11. The downhole tool of claim 10, wherein the first and second anti-rotation features are fully engaged when the downhole tool is in a fourth position.

12. The downhole tool of claim 11, wherein the portion of the first anti-rotation feature contacts the portion of the second anti-rotation feature such that the gap is no longer present when the first and second anti-rotation features are fully engaged.

13. A downhole tool, comprising:

a top sub;

a bottom sub defining one or more bottom sub ports, wherein an end of the bottom sub comprises a first anti-rotation feature;

a housing defining one or more housing ports;

a first sleeve positioned radially between the bottom sub and the housing, wherein the first sleeve blocks fluid flow between the one or more bottom sub ports and the one or more housing ports when the downhole tool is in a first position;

a second sleeve positioned radially between the bottom sub and the housing, wherein the first sleeve and the second sleeve permit fluid flow between the one or more bottom sub ports and the one or more housing ports when the downhole tool is in a second position, wherein fluid communicates through an axial bore, the one or more bottom sub ports, and the one or more housing ports, to an exterior of the housing when the downhole tool is in the second position, wherein the second sleeve blocks fluid flow between the one or more bottom sub ports and the one or more housing ports when the downhole tool is in a third position, and wherein the second sleeve comprises a second anti-rotation feature that is configured to partially engage with the first anti-rotation feature when the downhole tool is in the third position; and a landing seat coupled to the second sleeve when the downhole tool is in the first position, the second position, and the third position, wherein the landing seat is configured to receive an impediment, and wherein the landing sleeve is configured to be decoupled from the second seat in response to pressure applied to the impediment.

14. The downhole tool of claim 13, wherein the housing is coupled to and positioned at least partially axially between the top sub and the bottom sub, wherein at least a portion of the housing is positioned radially outward from the bottom sub, wherein the one or more housing ports are aligned with the one or more bottom sub ports, wherein the axial bore extends through the top sub, the bottom sub, and the housing, wherein the downhole tool further comprises a rupture disk configured to block fluid flow from the axial bore into an annulus between the bottom sub and the housing when the downhole tool is in the first position, and wherein the rupture disk is configured to rupture at a predetermined pressure, thereby permitting fluid flow from the axial bore into the annulus.

15. The downhole tool of claim 13, further comprising:

a shearable member coupling the second sleeve to the top sub, the bottom sub, the housing, or a combination thereof, wherein the shearable member is configured to shear at least partially in response to the landing seat receiving the impediment, and wherein the downhole tool actuates from the second position into the third position at least partially in response to the shearable member shearing; and a ring coupled to the second sleeve, wherein the ring is configured to engage a first recess in the housing, the bottom sub, or both when the downhole tool is in the third position, wherein the ring is configured to engage a second recess in the housing, the bottom sub, or both when the downhole tool is in a fourth position, and wherein the first and second recesses are axially offset from one another.

16. The downhole tool of claim 13, further comprising a shearable member coupling the landing seat to the second sleeve when the downhole tool is in the first position, the second position, the third position, a fourth position, or a combination thereof, wherein the shearable member is configured to shear at least partially in response to increasing pressure in the axial bore above the impediment and the landing seat, wherein the downhole tool actuates from the fourth position into a fifth position at least partially in response to the shearable member shearing, and wherein the landing seat and the impediment are not positioned within the axial bore when the downhole tool is in the fifth position.

17. A method for cementing a tubular member within a wellbore, the method comprising:

running a downhole tool into the wellbore in a first position, wherein a first sleeve of the downhole tool blocks fluid communication from an axial bore of the downhole tool through one or more radial ports of the downhole tool when the downhole tool is in the first position;

actuating the downhole tool from the first position into a second position, wherein fluid communication is permitted from the axial bore through the one or more radial ports when the downhole tool is in the second position;

pumping cement into the wellbore when the downhole tool is in the second position, wherein the cement flows from the axial bore, through the one or more radial ports, and to an exterior of the downhole tool, and wherein the downhole tool comprises an anti-rotation feature that is disengaged when the downhole tool is in the first position and the second position; and actuating the downhole tool from the second position into a third position, wherein a second sleeve of the downhole tool blocks fluid communication from the axial bore through the one or more radial ports when the downhole tool is in the third position, and wherein the anti-rotation feature is partially engaged when the downhole tool is in the third position.

18. The method of claim 17, wherein actuating the downhole tool from the second position into the third position comprises pumping an impediment into the wellbore, wherein the impediment is received in a seat of the downhole tool, and wherein the seat is coupled to the second sleeve.

19. The method of claim 18, wherein the second sleeve comprises a retaining member that is positioned at least partially within a first recess in the downhole tool when the downhole tool is in the third position.

20. The method of claim 19, further comprising actuating the downhole tool from the third position into a fourth position, wherein the second sleeve blocks fluid communication from the axial bore through the one or more radial ports when the downhole tool is in the fourth position, and wherein the retaining member is positioned at least partially within a second recess in the downhole tool when the downhole tool is in the fourth position.

21. The method of claim 20, further comprising actuating the downhole tool from the fourth position into a fifth position, wherein the second sleeve blocks fluid communication from the axial bore through the one or more radial ports when the downhole tool is in the fifth position, and wherein the seat and the impediment move out of the axial bore when the downhole tool actuates from the fourth position into the fifth position.

* * * * *